United States Patent [19]

Terry et al.

[11] Patent Number: 4,464,975

[45] Date of Patent: Aug. 14, 1984

[54] CONTROL OF DISPERSION OF GUN SYSTEMS

[75] Inventors: Edgar R. Terry, Richmond; Joseph A. Hudock, Shelburne, both of Vt.

[73] Assignee: General Electric Company, Burlington, Vt.

[21] Appl. No.: 335,436

[22] Filed: Dec. 29, 1981

[51] Int. Cl.[3] ..... F41G 5/00

[52] U.S. Cl. ..... 89/41 SM

[58] Field of Search ..... 89/41 A, 41 ME, 41 SM

[56] References Cited

U.S. PATENT DOCUMENTS 3,974,740 8/1976 Billottet et al. ..... 89/41 SM 4,244,272 1/1981 Terry et al. ..... 89/41 A

FOREIGN PATENT DOCUMENTS 684706 12/1939 Fed. Rep. of Germany ... 89/41 SM

*Primary Examiner*—Stephen C. Bentley

*Attorney, Agent, or Firm*—Bailin L. Kuch

[57] ABSTRACT

A feature of this invention is the provision of a dispersion control which continually displaces the aimpoint of the gun system about its nominal aimpoint in a pattern which is determined by the future slant range and the desired ballistic pattern for the specific target.

6 Claims, 25 Drawing Figures

0°

30°

60°

90°

120°

150°

180°

0°

30°

60°

90°

120°

150°

180°

CONTROL OF DISPERSION OF GUN SYSTEMS

BACKGROUND OF THE INVENTION

1. Field of the Invention

This invention relates to a mechanism for controlling the dispersion of flexible, high rate of fire, gun systems.

A flexible gun system, as distinguished from a fixed, forward firing gun system, is one which is continuously directed during target engagement for movement in both the vertical and horizontal planes. Dispersion control is the continuous adjustment of the size, density, shape and orientation relative to the target of the ballistic pattern during the tracking and/or firing interval. Conventional flexible gun system performance is largely influenced by the nature of the tracking and gun-order errors which are stochastically (statistically) non-stationary because of glint, projectile time of flight, etc., and by inherent range-dependent biases such as dynamic servo lag due to target angular acceleration. Dispersion control enhances this performance by essentially "matching" these systematic errors and inherent system biases with appropriate values of random or ballistic dispersion. This process thereby ensures that when a large number of projectiles is placed rapidly in the vicinity of the target, hits will result in the small target subarea which is vulnerable to the striking projectiles.

For high firing-rate single- or multi-barrel flexible gun systems firing a plurality of projectiles sequentially in a uniform series, the ballistic pattern is defined by the rapid and continuous sequence of the projectiles directed at the target. The projectiles do not generally follow each other on exactly the same path, and, as a consequence, a dispersed pattern is built up. The statistical characteristics of the resulting pattern generally involve three aspects. First, given target detection and assignment, there is the process involving certain random elements of bringing the gun to bear on target and keeping it on target during the engagement. From this process, the requisite gun orders are generated. Because the errors in tracking are both auto- and cross-correlated, so too are the gun orders generated. Superimposed on the tracking and gun-order generation process is the second aspect, viz., ballistic dispersion. This process also involves several random elements, but in a different manner from the first aspect. This random or ballistic dispersion varies from projectile to projectile, i.e., it is uncorrelated. Since the first aspect is superimposed on this aspect, the tracking and gun-order auto- and cross-correlations are induced on the sequentially-ordered projectiles as they are fired. The third aspect arises because many of the target engagement parameters—individual projectile hit probabilities, target vulnerability, auto- and cross-correlations, projectile times-of-flight, etc.—can and do change markedly during the engagement. These essentially Lexian effects must be accounted for since they can change at a rate equal to or greater than the gun cyclic rate of fire.

2. Prior Art

Terry and Hudock in U.S. Pat. No. 4,244,272, issued Jan. 13, 1981 have shown a mechanism to provide a predetermined and constant dispersion pattern of projectiles fired at a target by a fixed forward-firing Gatling-type gun by continually adjusting the alignment of the barrels of the rotating barrel cluster of the gun with respect to the mean boresight of the cluster as a function of the instantaneous slant range to the target and the average muzzle velocity of the projectiles.

Exemplary prior art is set out at length in U.S. Pat. No. 4,244,272, supra, and is hereby incorporated by reference. The prior art mechanisms apply only to multi-barrel guns. Further, except for U.S. Pat. No. 4,244,272, supra, no attempt has been made to develop an attendant logic for controlling these mechanisms, i.e., based on the engagement conditions to control the parameters of size, shape, density, and orientation of the ballistic pattern being progressively built up in the region of the target during the firing interval. These parameters, inter alia, collectively influence whether or not hits are obtained on the target and, more importantly, whether or not the target is damaged to some acceptable state.

SUMMARY OF THE INVENTION

It is an object of this invention to provide a mechanism for the continuous control of the dispersion of a flexible, high rate of fire, gun system.

It is a further object to provide such a mechanism which will keep the size, density and shape of the ballistic pattern constant during the tracking and/or firing interval, and which will concurrently continuously orient this pattern to the target as the kinematics of the engagement demand.

A feature of this invention is the provision of a dispersion control which continually displaces the aimpoint of the gun system about its nominal aimpoint in a pattern which is determined by the future slant range and the desired ballistic pattern for the specific target.

BRIEF DESCRIPTION OF THE DRAWING

These and other objects, features and advantages of the invention will become apparent from the following specification thereof taken in conjunction with the accompanying drawing in which.

DESCRIPTION OF THE INVENTION

Figure 1A:
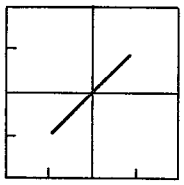
FIGS. 1A through 1G show a series of zero amplitude growth target patterns embodying this invention against a stationary target.
Figure 1B:
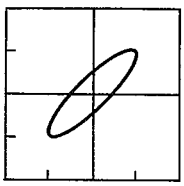
Figure 1C:
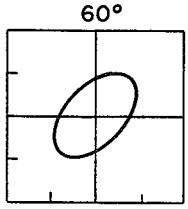
Figure 1D:
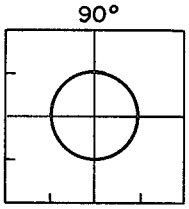
Figure 1E:
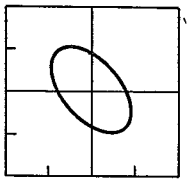
Figure 1F:
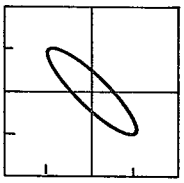
Figure 1G:
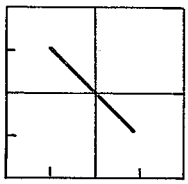
Figure 2A:
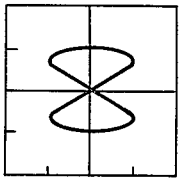
FIGS. 2A through 2G show a second series of zero amplitude growth target patterns embodying this invention against a stationary target.
Figure 2B:
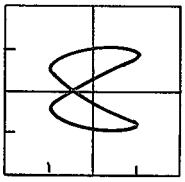
Figure 2C:
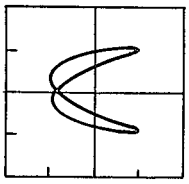
Figure 2D:
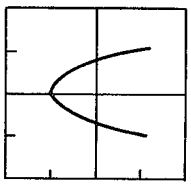
Figure 2E:
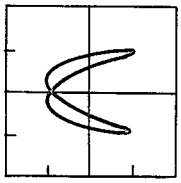
Figure 2F:
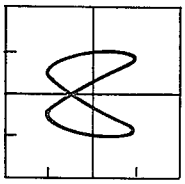
Figure 2G:
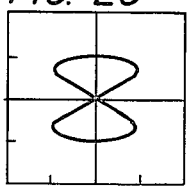
Figure 3A:
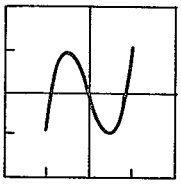
FIGS. 3A through 3G show a third series of zero amplitude growth target patterns embodying this invention against a stationary target.
Figure 3B:
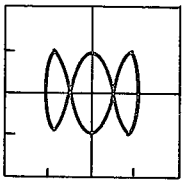
Figure 3C:
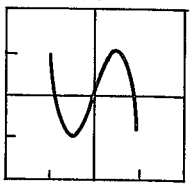
Figure 3D:
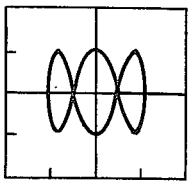
Figure 3E:
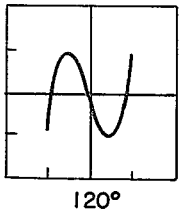
Figure 3F:
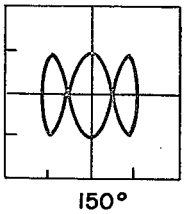
Figure 3G:
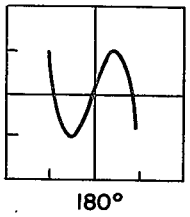

The invention encompasses the continual displacement in a prescribed manner of the aimpoint of the gun system about its nominal aimpoint. This is accomplished by superimposing pattern control signals on the conventional gun order signals which control the gun aiming servo system. The pattern control signals may conveniently be two coded harmonic signals generated from an azimuth frequency signal and an azimuth phase signal, and an elevation frequency signal and an elevation phase signal. These signals are in turn a function of the slant range to the target, the desired projectile pattern size, shape, and density at the target, and the engagement kinematics. The specified size, shape, and density of this ballistic pattern is directly related to the auto- and cross-correlated components of the tracking and gun-order errors generated during the engagement and the target vulnerable area presented towards the gun system. These data can be readily obtained from field test measurements and terminal ballistic data handbooks. For example, these signals are a function of the slant range to the target and the projected area of the target, on a plane normal to the line of fire as identified by the fire control system or the gunner. This projected area defines the desired ballistic pattern in two dimensions for the vulnerable area of the specific target, but does not necessarily envelop the entire target. The projected area on the normal plane in turn is a function of the target shape, the velocity vector of the target and the component of the acceleration vector of the target which is normal to the velocity vector. Thus the specified size, shape and density of the ballistic pattern is directly related to the auto-correlated and cross-correlated components of the tracking and gun-order errors generated during the engagement, and the target vulnerable area normal to the mean trajectory of the projectiles. The gun system may have a single barrel or a rotating barrel cluster. While a pattern may be generated by any two signals, simple Lissajous patterns, i.e., stationary patterns, can be generated essentially from combinations of two simple harmonic signals or oscillations orthogonal to one another and of differing frequencies. For any one coordinate, i.e., a single harmonic signal, the desired displacement $H_i$ of the $i^{th}$ projectile from its corresponding generated gun-order coordinate as predicted is given by $$H_i = H_O \cos(2\pi ft + \xi) \tag{1}$$

where $H_O$ is the amplitude, ($\xi$) is the phase angle, (f) is the frequency, and (t) is time. A similar equation can be written for the second coordinate. The instantaneous velocity (v) associated with this displacement in one coordinate is given by $$v = dH/dt = -2\pi f H_O \sin(2\pi ft + \xi) \tag{2}$$

and the instantaneous acceleration (a) of this displacement in one coordinate is given by $$a = d^2H/dt^2 = -4\pi^2 f^2 H_O \cos(2\pi ft + \xi). \tag{3}$$

Various ballistic patterns of fixed size can be generated by use of two of these signals, by varying the frequencies (pattern shape and density) and phase angles (pattern shape and orientation relative to the target). Such patterns would be effective against targets at a fixed range.

In FIGS. 1A through 1G the shape of the pattern, generated by two sinewave signals, one each in the X- and Y-coordinates, at the target is shown in mils for a target at 4000 feet and having a velocity of zero feet per second, using a gun system having a firing rate of 3000 shots per minute in a one second burst. The frequency ratio of the two signals is freq (Y):freq (X)=1 hertz:1 hertz. The amplitude ratio is amp (Y):amp (X)=1 mil:1 mil. The phase angle (X) is zero degrees. The phase angle (Y) varies from zero degrees in FIG. 1A to 180 degrees in FIG. 1G by 30 degree increments.

In FIGS. 2A through 2G the shape of the pattern, generated by two sinewave signals, one each in the X- and Y-coordinates, at the target is shown in mils for a target at 4000 feet and having a velocity of zero feet per second, using a gun system having a firing rate of 3000 shots per minute in a one second burst. The frequency ratio is freq (Y):freq (X)=1 hertz:2 hertz. The amplitude ratio is amp (Y):amp (X)=1 mil:1 mil. The phase angle (Y) is 45 degrees. The phase angle (X) varies from zero degrees in FIG. 2A to 180 degrees in FIG. 2G by 30 degree increments.

In FIGS. 3A to 3G the shape of the pattern, generated by two sinewave signals, one each in the X- and Y-coordinates, at the target is shown in mils for a target at 4000 feet and having a velocity of zero feet per second, using a gun system having a firing rate of 3000 shots per minute in a one second burst. The frequency ratio is freq (Y):freq (X)=3 hertz:1 hertz. The amplitude ratio is amp (Y):amp (X)=1 mil:1 mil. The phase angle (Y) is zero degrees. The phase angle (X) varies from zero degrees in FIG. 3A to 180 degrees in FIG. 3G by 30 degree increments.

Against moving targets, the angular ballistic dispersion must be constantly adjusted to maintain a constant pattern size at the target. This can be done as shown in U.S. Pat. No. 4,244,272, supra, by setting into Equation (1) for a single coordinate the quantity:

$$H_0 = \sigma_{B0}\left(\frac{R}{R - V_a t}\right) \tag{4}$$

where R is the future slant range between gun and target, $V_a$ is the target velocity, and $\sigma_{BO}$ is the inherent dispersion associated with the gun system. Now for any one coordinate, the desired displacement $H_i$ of the $i^{th}$ projectile from its corresponding generated gun order coordinate as predicted is given by $$H_i = \sigma_{B0}\left(\frac{R}{R - V_a t}\right) \cos(2\pi ft + \xi). \tag{5}$$

From Equation (5), the instantaneous velocity (v) of the growth in amplitude of the displacement in one coordinate is given by $$v = \frac{dH}{dt} = \sigma_{B0}\left(\frac{R}{R - V_a t}\right)(-2\pi f \sin(2\pi ft + \xi)) + \sigma_{B0}\left(\frac{R V_a}{(R - V_a t)^2}\right)(\cos(2\pi ft + \xi)) \tag{6}$$

and the instantaneous acceleration (a) of this amplitude growth in one coordinate is given by $$a = \frac{d^2H}{dt^2} = \sigma_{B0}\left(\frac{R}{R - V_a t}\right)\left[-4\pi^2 f^2 \cos(2\pi ft + \xi) - \left(\frac{V_a}{R - V_a t}\right) 2\pi f \sin(2\pi ft + \xi)\right] + \sigma_{B0}\left(\frac{R\,V_a}{(R - V_a t)^2}\right) - \left[2\pi f \sin(2\pi ft + \xi) - \left(\frac{2V_a(B - V_a t)}{(R - V_a t)^2}\right)\cos(2\pi ft + \xi)\right]. \quad (7)$$

Equations (5) through (7) as well as Equations (1) through (3) must be digitized to take into account the gun cyclic rate of fire, the firing interval, the inherent ballistic dispersion, and the parameters of the harmonic signals. Define ($\tau$) as the reciprocal of the cyclic rate of fire in seconds and write $$H_0(\tau) \equiv \sigma_{B0}\left(\frac{R}{R - (i-1)V_a\tau}\right)$$

$$\frac{dH_0(\tau)}{dt} \equiv \sigma_{B0}\left(\frac{R\,V_a}{[R - (i-1)V_a\tau]^2}\right)$$

and $$\frac{d^2H_0(\tau)}{dt^2} \equiv \sigma_{B0}\left(\frac{2R\,V_a^2}{[R - (i-1)V_a\tau]^3}\right).$$

Then indexing on the rounds to be fired during the interval, Equations (5) through (7) respectively can be rewritten as $$H_i = H_0(\tau)\cos(2\pi ft + \xi) \quad (8)$$

$$v = -2\pi f H_0(\tau)\sin(2\pi ft + \xi) + \frac{dH_0(\tau)}{dt}\cos(2\pi ft + \xi) \quad (9)$$

and $$a = -4\pi f \frac{dH_0(\tau)}{dt}\sin(2\pi ft + \xi) + \cos(2\pi ft + \xi)\left[\frac{d^2H_0(\tau)}{dt^2}(\tau) - 4\pi^2 f^2 H_0(\tau)\right]. \quad (10)$$

Figure 4:
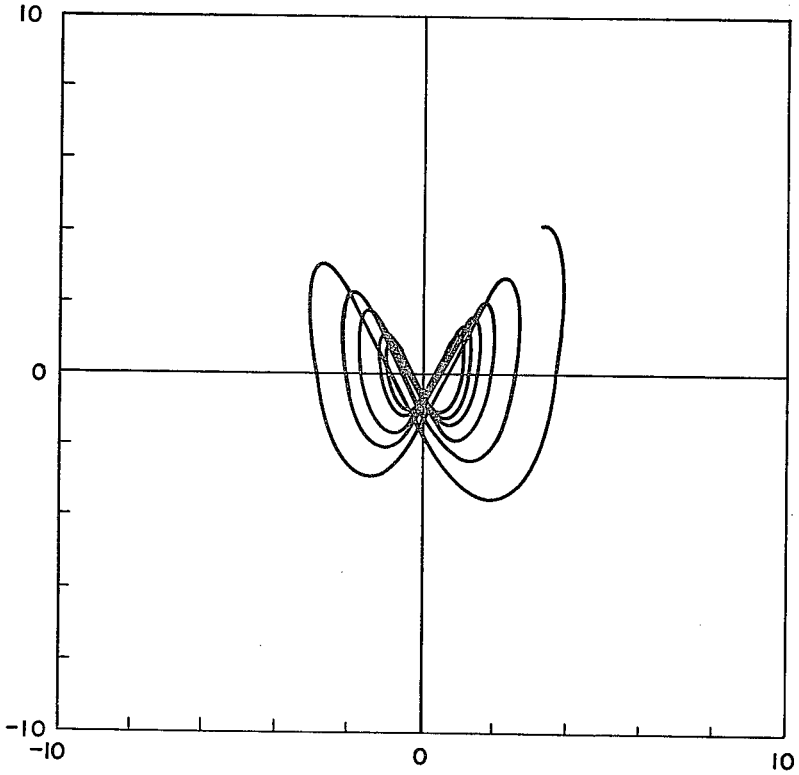
FIG. 4 shows a fourth, non-zero amplitude growth pattern embodying this invention against a closing, constant velocity target, flying directly towards the gun system.

In FIG. 4 the shape of the pattern, generated by two sinewave signals, one each in the X- and Y-coordinates, at the target is shown in mils for a target initially at 4000 feet and having a velocity of 500 feet per second directly towards the gun system, using a gun system having a firing rate of 3000 shots per minute in a six second burst. The frequency ratio is freq (Y):freq (X)=2 hertz:1 hertz. The amplitude ratio is amp (Y):amp (X)=1 mil:1 mil. The phase angle (Y) is zero degrees. The phase angle (X)=thirty degrees.

Figure 5:
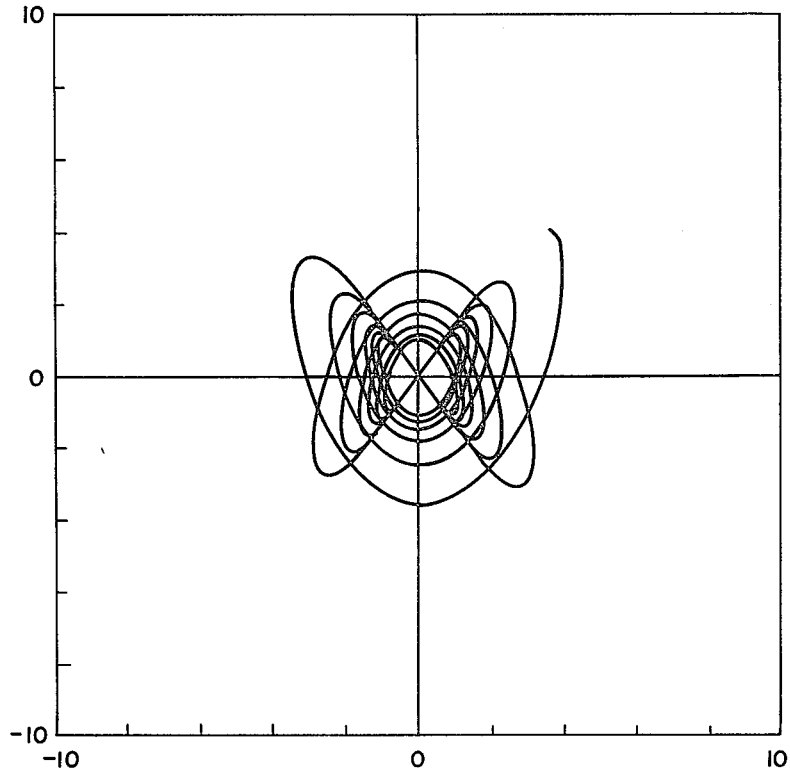
FIG. 5 shows a fifth, non-zero amplitude growth pattern embodying this invention against a closing, constant velocity target, flying directly towards the gun system.

In FIG. 5 the shape of the pattern, generated by two sinewave signals, one each in the X- and Y-coordinates, at the target is shown in mils for a target initially at 4000 feet having a velocity of 500 feet per second directly towards the gun system, using a gun system having a firing rate of 3000 shots per minute in a six second burst. The frequency ratio is freq (Y):freq (X)=3 hertz:2 hertz. The amplitude ratio=amp (Y):amp (X)=1 mil:1 mil. The phase angle (Y) is zero degrees. The phase angle (X) is thirty degrees.

Figure 6:
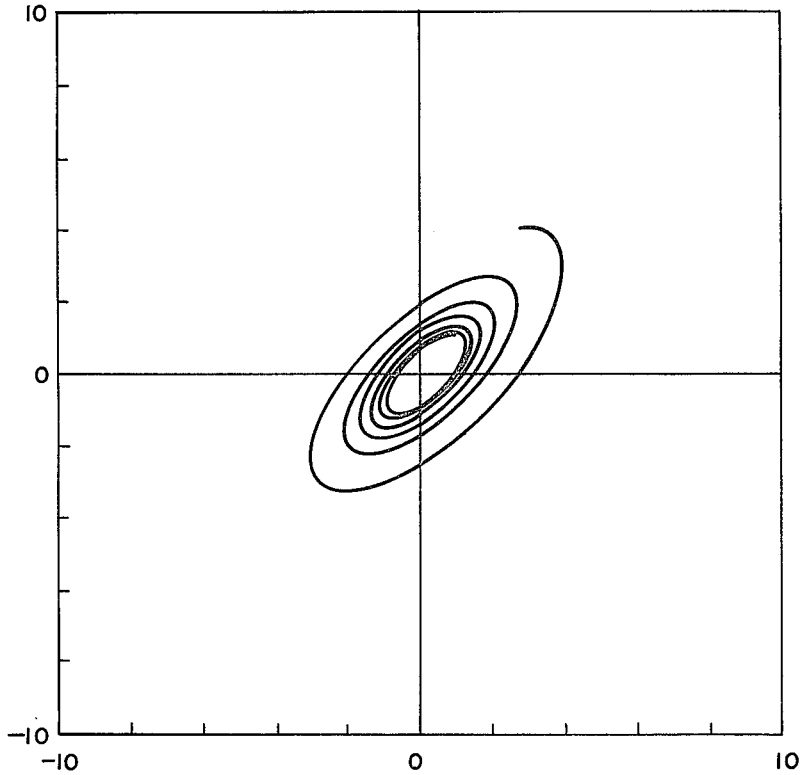
FIG. 6 shows a sixth, non-zero amplitude growth pattern embodying this invention against a closing, constant velocity target, flying directly towards the gun system.

In FIG. 6 the shape of the pattern, generated by two sinewave signals, one each in the X- and Y-coordinates, at the target is shown in mils for a target initially at 4000 feet having a velocity of 500 feet per second directly towards the gun system, using a gun system having a firing rate of 3000 shots per minute in a six second burst. The frequency ratio is freq (Y):freq (X)=1 hertz:1 hertz. The amplitude ratio is amp (Y):amp (X)=1 mil:1 mil. The phase angle (Y) is zero degrees. The phase angle (X) is forty-five degrees.

As an example of the application of this invention, assume that the flexible gun system is firing at an aircraft target. The assumed desired pattern size at the target is 50 square feet when the front of the target is presented, 200 square feet when the side of the target is presented, 300 square feet when the bottom of the target is presented. Assuming that the target can be characterized by an ellipsoid in three dimensional space having as its projected areas, when viewed along its three principal axes, the previously postulated 50 square feet, 200 square feet, and 300 square feet, the surface of the target ellipsoid can be characterized by the expression $$X_T^2/a^2 + Y_T^2/b^2 + Z_T^2/c^2 = 1$$

where $X_T$ is along an axis aligned with the target velocity vector (assumed to be out the nose of the aircraft); $Y_T$ is along an axis aligned with the target acceleration normal to the velocity vector (assumed to be out the top of the aircraft); and $Z_T$ is along an axis normal to $X_T$ and $Y_T$ (assumed to be out the right wing of the aircraft).

The target ellipsoid projected areas are related to the a, b, and c coefficients in the above expression by: $A_S = \pi ab$, which is the side area of 200 square feet; $A_B = \pi ac$, which is the bottom area of 300 square feet, and $A_F = \pi bc$, which is the frontal area of 50 square feet. Thus, b is 3.257 feet, c is 4.886 feet, and a is 19.546 feet.

The target ellipsoid, when viewed along the gun line, describes an ellipse which is the desired pattern size and shape at the target. The pattern size and shape relative to the flexible gun system gun line can be calculated from the target information estimated by the fire control computer in establishing the target's future position (where the projectiles fired by the gun are intended to intercept the target).

In the case of a target directly approaching the gun system, the $X_T$ axis of the previously described target will be coincident with the gun line with the exception of adjustments made in the gun line for projectile drop due to gravity and deflection due to wind. Neglecting these small adjustments in establishing the desired pattern size and assuming the aircraft is flying with its wings parallel to the horizon, the desired pattern is thus an ellipse having a major axis of 4.886 feet parallel to the horizon and a minor axis of 3.257 feet. Both of these axes are perpendicular to the gun line. The desired elliptical pattern can be generated at the target. The desired pattern is established as described in U.S. Pat. No. 4,244,272, supra, and the application of Equation (1). The phase angle ($\xi$ in Equation (1)) in azimuth ($\psi_a$) and elevation ($\psi_e$) will, in this example, differ by 90 degrees. The amplitude ($H_O$ in Equation (1)) at a range of 1500 feet will be in azimuth 4.886/1500 radians or 3.28 mils and in elevation 3.257/1500 radians or 2.17 mils.

The flexible gun system performance characteristics place design constraints on the dispersion control system, viz., the system bandwidth, gun-order response, available power, and the system acceleration capabilities. As the frequencies of the dispersion control sinusoidal signals approach the gun system bandwidth, there is a corresponding degradation of the system in generating the desired pattern, resulting in an attenuation of the signal amplitudes and a system-induced shift in the signal phase. These effects can be minimized by essentially increasing the apparent bandwidth of the flexible gun system in response to signal inputs. This is done by providing both a signal for the desired angular position and a signal for the desired angular rate to the system's servo amplifiers. The rate signal improves the response time of the system and provides the requisite bandwidth, while the position signal is needed primarily to eliminate errors that could increase with time if only a rate signal is available.

The average power to the gun system is proportional to the square of the amplitude of the sinusoidal signal and the cube of the frequency of this signal. The corresponding acceleration required increases linearly with the amplitude of a sinusoid and will also increase as a function of the square of the frequency. In general, the limiting factor of flexible gun systems is the limit on servo motor current in keeping the gun on target. Given a well-designed system having negligible friction, a motor current limit can be expressed as an upper bound on acceleration. Thus, the limits on achievable dispersion can be expressed as a function of the amplitude and frequency of the dispersion signals.

Figure 7:
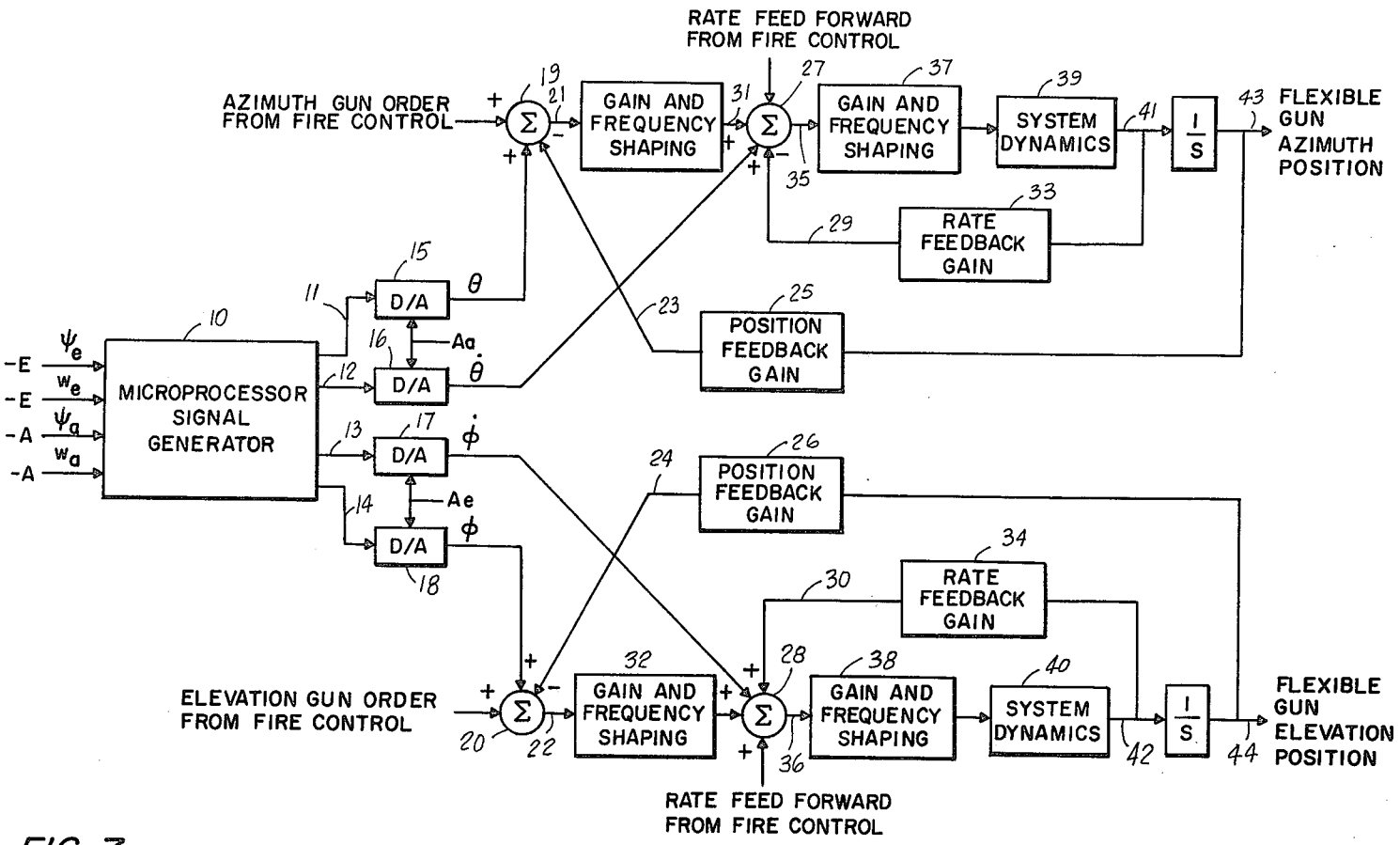
FIG. 7 is a block diagram of a gunnery system embodying this invention and having harmonic dispersion control by which the size, shape, density and orientation of the ballistic pattern can be continuously adjusted during the tracking and/or firing interval.

A block diagram of the dispersion control system is shown in FIG. 7. The basic ballistic pattern shape, as shown above, is determined by the frequency and phase selected for the signals to be generated in the two principal axes, i.e., azimuth and elevation. The azimuth frequency ($w_a$) and phase ($\psi_a$) and the elevation frequency ($w_e$) and phase ($\psi_e$) are inputs to a microprocessor 10. These are the logic control signals that are used by the microprocessor software to determine the output signal sequence. These four data are provided by the fire control system or by the gunner and, as previously mentioned, are a function of the slant range to the target, and the target projection on the plane normal to the line of fire. The basic data used to construct a sinusoidal signal and its associated derivative for each selectable frequency, as given by Equations (8) and (9), are stored within the microprocessor. At the beginning of an output sequence, the microprocessor examines the control inputs and calculates the addresses in its memory from which the sinusoid signals and derivatives must start. The microprocessor then cycles through the complete range of addresses as determined by the selected frequency and sequentially outputs the data from each address. This results in a quantized sinusoidal output for azimuth position and rate and elevation position and rate. These signals are equivalent to those obtained by sampling continuous sinusoids and quantizing the resultant to the data word length of the microprocessor. A sampling rate of 180 samples per second and a word length of eight bits are exemplary. The signals at 11, 12, 13, and 14 are eight-bit digital signals that are converted to analog voltage signals by the digital-to-analog converters, D/A, at 15, 16, 17, and 18. These D/A converters have a multiplying capability; the sinusoidal signals are multiplied by an analog signal ($A_a$ for azimuth and $A_e$ for elevation) scaled to the desired size of ballistic dispersion pattern. Thus, the signals at the outputs of the digital-to-analog converters are those signals corresponding to the angular position and rate in both azimuth and elevation which provide the desired pattern. These signals are applied to the control system electronics of the flexible gun system.

The azimuth and elevation dispersion position signals, $\theta$ and $\phi$, respectively, are summed by amplifiers 19 and 20 with the corresponding electrical signals for the fire control gun orders and gun position feedback signals 21 and 22 within the control system electronics. The outputs 21 and 22 of amplifiers 19 and 20 are thus the difference between the desired angular position of the gun and the actual position of the gun 23 and 24. The electronic signals 23 and 24 are obtained from potentiometers or electronic resolvers 25 and 26 whose mechanical input shaft is coupled through gears to the gun mount. The azimuth and elevation dispersion rate signals, $\theta$ and $\phi$ respectively, are summed by amplifiers 27 and 28 with the corresponding rate feed forward gun orders from the fire control, the tachometer (rate) feedback signals 29 and 30, and electronically filtered position error signals 31 and 32 within the control system electronics. The electrical signals 29 and 30 are the electrical output of tachometers 33 and 34 coupled through gears to the gun mount. The electrical signals 35 and 36 obtained from the outputs of amplifiers 27 and 28, respectively, are filtered and amplified by additional control system electronics 37 and 38 to produce electrical power for driving the flexible gun system motors and gun mechanical positioning mechanism 39 and 40. The angular rates at which the gun changes position in azimuth and elevation 41 and 42 are measured by tachometers 33 and 34. The angular positions of the gun in azimuth and elevation 43 and 44, which are the integral over time of the gun angular rates, are measured by potentiometers or resolvers 25 and 26. The azimuth and elevation angular positions 43 and 44, respectively, of the gun follow both the gun orders generated by the sum of the fire control and dispersion control signals. The sequential aimpoints or gun lines generated move about the positions determined by the fire control gun orders in a path determined by the amplitude, frequency, and phase of the dispersion control sinusoidal signals. We claim:

1. A gun system for controlling the dispersion pattern of a plurality of projectiles fired sequentially in a uniform series by a high rate of fire gun, and which pattern is obtained by varying the orientation of the line of sight of the gun, comprising:

a servomechanism, coupled to the gun, for receiving two mutually orthogonal primary signals which are a function of gun direction orders, and which orders are a function of the instantaneous slant range to the target and the instantaneous velocity of the target, and for orienting the line of sight of the gun in response to said primary signals;

a control means, coupled to said servomechanism, for supplying two mutually orothogonal additional signals to said servomechanism to be respectively combined with said two mutually orthogonal primary signals, which additional signals are a function of the desired dispersion pattern at the target of the projectiles fired by the gun, the future slant range to the target, and the instantaneous velocity of the target;

whereby, over a period of time, as the instantaneous slant range to the target and the instantaneous velocity of the target may vary, the dispersion pattern of the projectiles at the target remains constant.

2. A system according to claim 1 wherein said additional signals are two continuously variable sine wave signals.

3. A gun system for controlling the dispersion pattern of a plurality of projectiles fired sequentially in a uniform series by a high rate of fire gun, comprising:

a servomechanism, coupled to the gun, for receiving primary signals which are a function of gun direction orders, and which orders are a function of the instantaneous slant range to the target and the instantaneous velocity of the target, and for orienting the line of sight of the gun in response to said primary signals;

a control means, coupled to said servomechanism, for supplying additional signals to said servomechanism to be combined with said primary signals, which additional signals are a function of the desired dispersion pattern at the target of the projectiles fired by the gun, the future slant range to the target, and the instantaneous velocity of the target;

whereby, over a period of time, as the instantaneous slant range to the target and the instantaneous velocity of the target may vary, the dispersion pattern of the projectiles at the target remains constant, and said additional signals are two signals, one for each coordinate and each of the form:

$$H_i = \sigma_{B0}\left(\frac{R}{R - V_a t}\right) \cos(2\pi ft + \xi);$$

where:

$H_i$=the desired displacement of a projectile from its corresponding conventionally generated gun order coordinate;

$\sigma_{BO}$=the inherent dispersion of the gun system;

R=future slant range between the gun and the target;

$V_a$=the velocity of the target;

t=time;

f=the selected frequency of the signal; and $\xi$=the selected phase angle of the signal.

4. A process for varying the line of sight of a high rate of fire gun, which gun is oriented by a servomechanism, in a pattern to provide a constant dispersion pattern of a plurality of projectiles fired sequentially in a uniform series at the target comprising:

providing two mutually orthogonal primary signals which are a function of gun direction orders and which orders are a function of the instantaneous future slant range to the target and the instantaneous velocity of the target, providing two mutually orthogonal additional signals which are a function of the desired dispersion pattern of projectiles at the target fired by the gun and the instantaneous range to the target, and respectively combining said primary and additional signals and providing the resultant signals to said servomechanism for the orientation of said gun, whereby, over a period of time, as the instantaneous future slant range to the target and the instantaneous velocity of the target may vary, the dispersion pattern of the projectiles at the target remains constant.

5. A process according to claim 4 wherein said additional signals are two continuously variable sine wave signals.

6. A process for displacing the line of sight of a high rate of fire gun, which gun is oriented by a servomechanism, in a pattern to provide a constant dispersion pattern of a plurality of projectiles fired sequentially in a uniform series at the target comprising:

providing primary signals which are a function of gun direction orders and which orders are a function of the instantaneous future slant range to the target and the instantaneous velocity of the target, providing additional signals which are a function of the desired dispersion pattern of projectiles at the target fired by the gun and the instantaneous range to the target, and combining said primary and additional signals and providing the resultant signals to said servomechanism for the orientation of said gun, whereby, over a period of time, as the instantaneous future slant range to the target and the instantaneous velocity of the target may vary, the dispersion pattern of the projectiles at the target remains constant;

said primary signals comprise a pair of signals, one for each coordinate; and said additional signals comprise a pair of signals, one for each coordinate, and each of the form:

$$H_i = \sigma_{B0}\left(\frac{R}{R - V_a t}\right) \cos(2\pi ft + \xi);$$

where:

$H_i$=the desired displacement of a projectile from its corresponding conventionally generated gun order coordinate;

$\sigma_{BO}$=the inherent dispersion of the gun system;

R=future slant range between the gun and the target;

$V_a$=the velocity of the target;

t=time;

f=the selected frequency of the signal; and $\xi$=the selected phase angle of the signal.

* * * * *